US006984104B2

(12) United States Patent
Alexander et al.

(10) Patent No.: US 6,984,104 B2
(45) Date of Patent: Jan. 10, 2006

(54) VARIABLE VANE ARM/UNISON RING ATTACHMENT SYSTEM

(75) Inventors: Phillip Alexander, Colchester, CT (US); John Pickens, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 23 days.

(21) Appl. No.: 10/320,031

(22) Filed: Dec. 16, 2002

(65) Prior Publication Data

US 2004/0115045 A1 Jun. 17, 2004

(51) Int. Cl.
*F04D 29/56* (2006.01)

(52) U.S. Cl. ..... 415/159; 415/160; 415/191

(58) Field of Classification Search ..... 415/160, 415/162, 191, 208.2, 148, 165, 209.3, 159, 415/161

See application file for complete search history.

(56) References Cited

U.S. PATENT DOCUMENTS 3,954,349 A * 5/1976 Abild ..... 415/163
4,792,277 A * 12/1988 Dittberner et al. ..... 415/160
4,979,874 A * 12/1990 Myers ..... 415/160
6,325,531 B1 * 12/2001 Lindley ..... 366/121
6,330,995 B1 * 12/2001 Mangeiga et al. ..... 248/554

* cited by examiner

*Primary Examiner*—Edward K. Look
*Assistant Examiner*—Dwayne J. White
(74) *Attorney, Agent, or Firm*—Bachman & LaPointe, P.C.

(57) ABSTRACT

An attachment system for use with a variable incidence vane is disclosed. The attachment system includes a vane arm for joining a unison ring to a vane spindle. The vane arm has an arm portion and a bushing connected to the arm portion. The attachment system further has a pin for joining the vane arm to the unison ring. The pin fits within an interior bore in the bushing and is joined to the unison ring by a dual swage.

11 Claims, 3 Drawing Sheets

VARIABLE VANE ARM/UNISON RING ATTACHMENT SYSTEM

BACKGROUND OF THE INVENTION

The present invention relates to a variable vane arm/unison ring/vane attachment system for use in a variable incidence vane system in a gas turbine engine.

A variable vane arm 11 is used to control the incidence angle of vanes 8 in the compressor section of gas turbine engines. The vanes 8 are arranged as a stage set around the circumference of the compressor. The vane arm 11 attaches to each vane spindle 26 which rotates in a bearing mounted in the compressor case. The set of vanes 8 in a stage are actuated by a circumferential synchronizing or unison ring 15 that rotates about the engine axis. The vane arm 11 imparts motion from the synchronizing ring 15 to the vane spindle 26 and has to accommodate all the relative motion between the ring 15 and the vane 8.

A current vane arm/unison ring attachment system 10 is illustrated in FIG. 1. The vane arm 11 used therein incorporates a brazed bushing 12 which has chamfered reliefs 14 to allow for differences in kinematic motion of the vane arm 11, which travels in a planar arc relative to the engine circumference, and the unison ring 15 which rotates about the engine center line and translates axially. The bushing 12 interfaces with a pin 16 attached to the unison ring 15 by means of a single swage and a tack weld.

Referring now to FIG. 2, the vane arm 11 has a non-tapered claw feature 20 which has two curved members 22 and 23 for engaging slots 24 and 25 in a vane spindle 26.

The current vane arm/unison ring attachment system suffers from a number of deficiencies including wear between the pin and vane arm bushing, a potential for relative vibration at the joint interface between the pin 16 and the unison ring 15, and slop at the inner diameter of the unison ring 15 which causes wear at the mating surface.

SUMMARY OF THE INVENTION

Accordingly, it is an object of the present invention to provide an improved attachment system for attaching a vane arm to a unison ring and to a variable vane spindle.

It is a further object of the present invention to provide an attachment system as above which is retrofittable.

It is still a further object of the present invention to provide an attachment system as above which has an increased bearing area to minimize wear.

It is yet a further object of the present invention to provide an attachment system as above which minimizes the potential for relative vibration at the joint interface.

It is yet another object of the present invention to provide an attachment system as above which creates damping and eliminates joint slop/hysteresis.

The foregoing objects are attained by the attachment system of the present invention.

In accordance with the present invention, an attachment system for use in a variable incidence vane system is provided. The attachment system comprises a vane arm for joining a unison ring to a variable vane spindle. The vane arm has an arm portion and a bushing connected to the arm portion. The attachment system further comprises a pin for joining the vane arm to the unison ring. The pin fits within the bushing and is joined to the unison ring by a dual swage.

The present invention also relates to a vane arm having an arm portion and a bushing connected to the arm portion. The arm portion has a thickness and the bushing has a height which is maximized to fit within a cross section of the unison ring with a clearance between top and bottom surfaces of the bushing sufficient to eliminate any potential for contact and subsequent wear of the top and bottom surfaces.

Other details of the variable vane arm/unison ring/vane attachment system, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
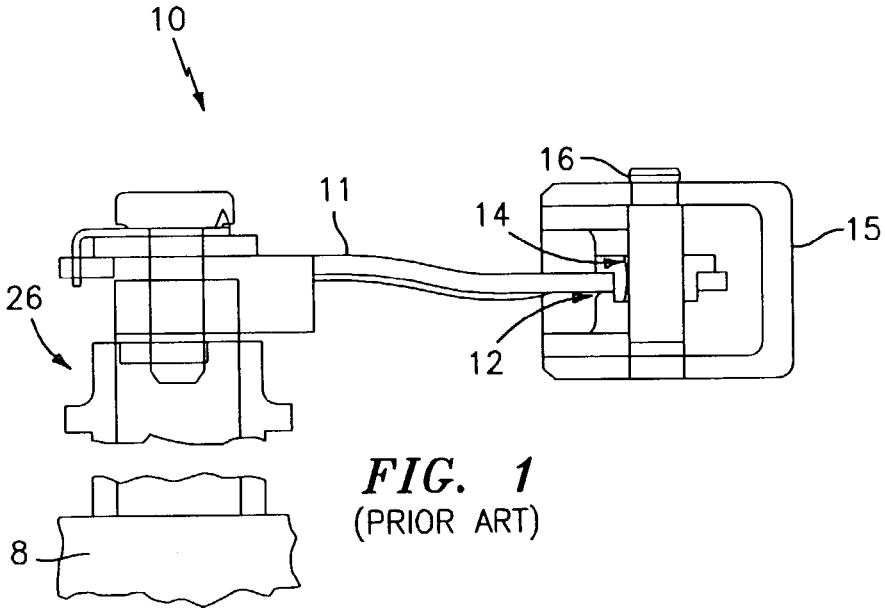
FIG. 1 (PRIOR ART)
FIG. 1 illustrates a current attachment system showing the attachment between the vane arm and the unison ring.
Figure 2:
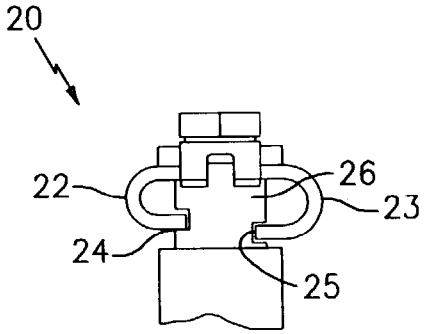
FIG. 2 (PRIOR ART)
FIG. 2 is a rear view of the attachment system of FIG. 1.

Referring now to the drawings, FIGS. 3–6 illustrates an improved vane arm 102 in accordance with the present invention for use in an attachment system 10 used in a variable incidence vane system within a gas turbine engine. The vane arm 102 is used to join a vane spindle 26 and a unison ring 15.

Figure 3:
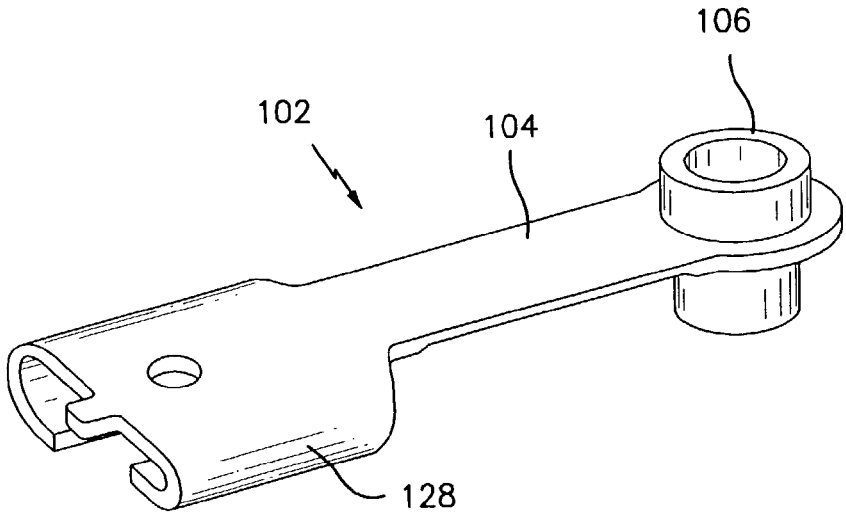
FIG. 3 is a perspective view of a vane arm in accordance with the present invention for use in a variable incidence vane attachment system.
Figure 6:
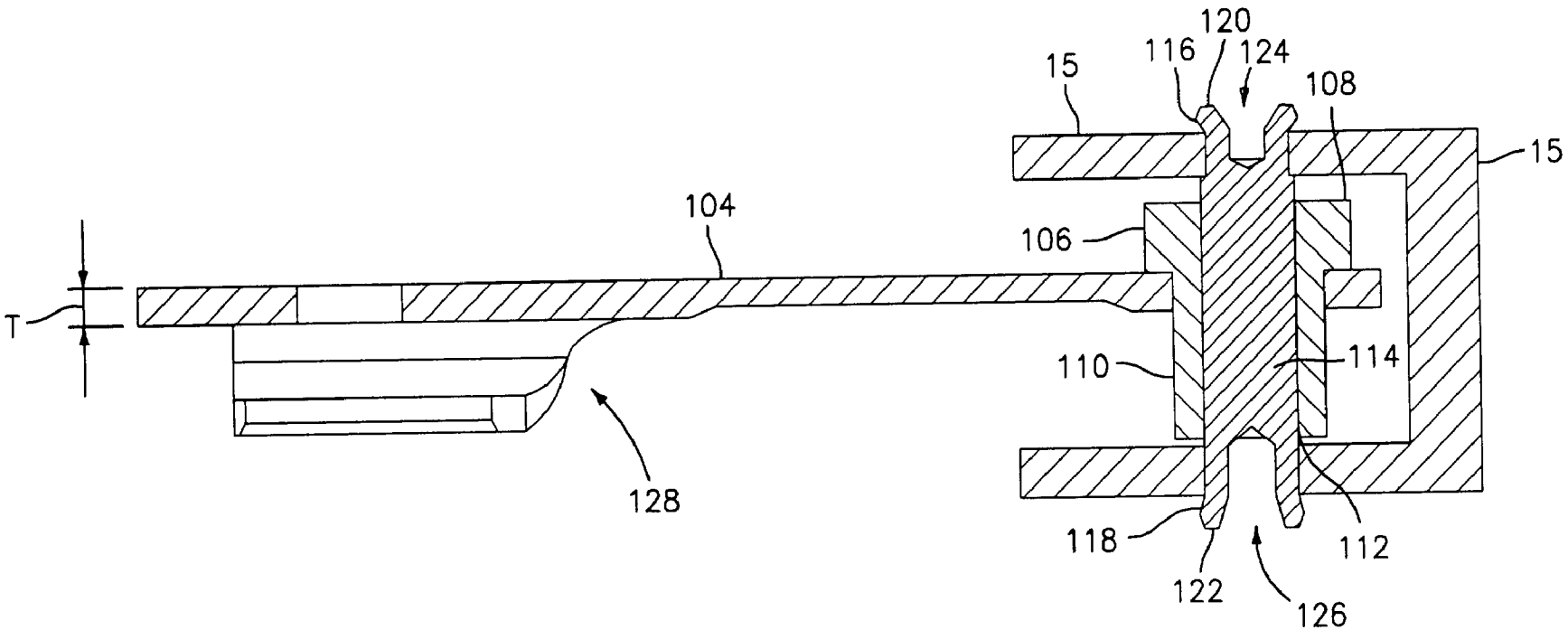
FIG. 6 is a sectional view illustrating the vane arm of FIG. 3 joined to a unison ring.

As shown in FIGS. 3 and 6, the vane arm 102 has an arm portion 104 with a thickness T. The arm portion 104 may be formed from any suitable material known in the art such as a nickel based alloy. A suitable nickel based alloy which may be used to form the arm portion 104 is Inconel 718.

The vane arm 102 also has a bushing 106 connected to it. In a preferred construction, the bushing 106 is joined to the vane arm 102 by brazing using any suitable brazing material such as a gold based alloy or a nickel based alloy. The bushing 106 may also be formed from a nickel based alloy such as Inconel 718. It may also be formed from any other suitable metallic material known in the art. While it is preferred to braze the bushing 106 to the vane arm 102, if desired, the bushing 106 may be integrally formed with the vane arm 102.

Figure 4:
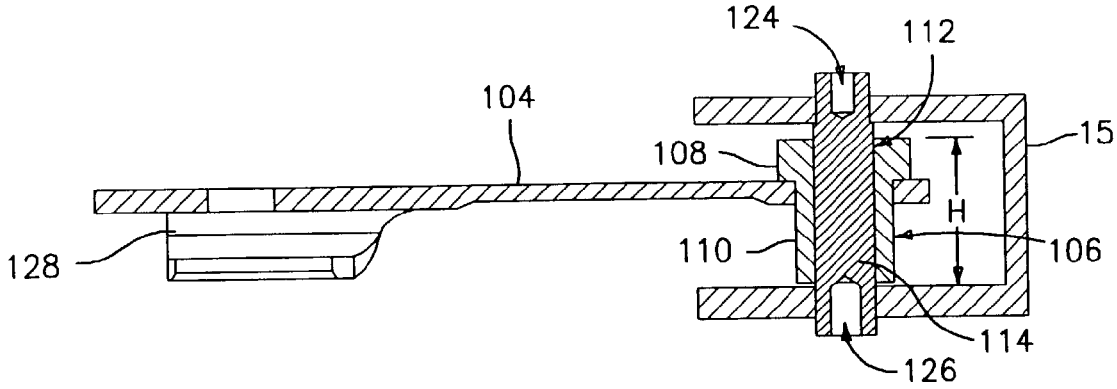
FIG. 4 is a sectional view of a vane arm in accordance with the present invention.

As can be seen from FIGS. 4 and 6, the bushing 106 has an upper portion 108 and a lower portion 110. The upper portion 108 has an outer diameter greater than the outer diameter of the lower portion 110. The bushing 106 has an interior bore 112 for receiving a pin 114 about which the bushing 106 can rotate. One of the features of the bushing 106 is that it has no chamfered reliefs.

The bushing 106 has a height H which is maximized to fit within the cross section of the unison ring 15. There is a clearance between the ring 15 and the top and/or bottom of bushing 106 to eliminate the potential for contact and subsequent wear at these surfaces. The value of the clearance is intended to accommodate the kinematic travel of the bushing 106 relative to the ring 15, i.e. the bushing 106 slides up the pin 114 as the ring 15 is rotated.

Referring now to FIG. 6, the vane arm 102 is joined to the unison ring 15 by the pin 114 which is sized to fit within the bore 112. The pin 114 has a first bore 124 machined in a first end and a second bore 126 machined in a second end 122.

The joint between the unison ring 15 and the pin 114 is formed by a first swage 116 at the first end 120 of the pin 114 and a second swage 118 at the second end 122 of the pin 114.

While it is not preferred to tack weld the first end 120 of the pin 114 to the unison ring 15, one could tack weld the first end 120 and/or the second end 122 if desired. Any suitable welding material known in the art may be used to form the tack weld.

The vane arm/unison ring attachment described hereinabove provides a number of key advantages. First, it is retrofittable with current variable incidence vane hardware. Second, the increased bushing height provides increased bearing area which minimizes wear. Third, there is a reduction in the relative degrees of freedom from four to two, which minimizes the potential for relative vibration at the joint interface between the arm 102 and the pin 114. Fourth, the joint preload provided by forced vane arm deflection creates damping and eliminates joint slop/hysteresis. Fifth, the dual swaging of the pin 114 eliminates slop at the inner diameter of the unison ring 15, preventing wear at that mating surface.

Figure 5:
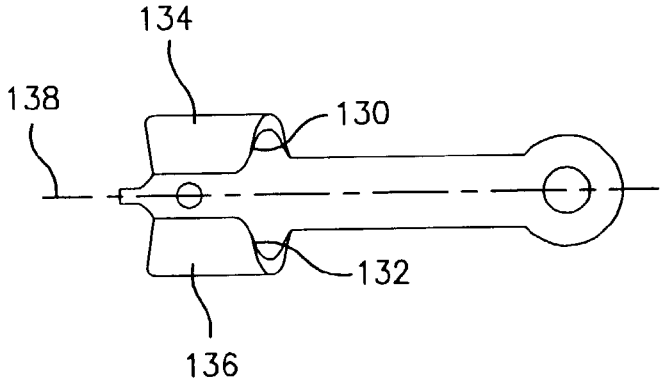
FIG. 5 is a bottom view of the vane arm of FIG. 3.

The vane arm 102 is also provided with an integrally formed claw feature 128 which has, as shown in FIG. 5, a tapered leading edge 130 and 132 on the first and second curved members 134 and 136 used to engage the offset slots 24 and 25 in a vane spindle 26. The tapered leading edges 130 and 132 taper inwardly from the leading edge of each curved member 134 and 136 towards a longitudinal axis 138 of the arm portion 104. As before, the first curved member 134 has a first radius of curvature and the second curved member 136 has a second radius of curvature which is different from the first radius of curvature. The purpose of the different radii of curvature is to provide a fool proofing feature which prevents the arm from being installed backwards on the vane.

The tapered claw feature 128 of the vane arm 102 provides a number of advantages. First, it reduces assembly fillet stress caused by interference fit with claw and vane spindle. Second, it reduces stress Kt caused by vane arm stem deflection and vane air loads. Third, it improves manufacturing ability to blend finish and inspect fillet area underneath the vane arm claw.

It is apparent that there has been provided in accordance with the present invention a variable vane arm/unison ring/vane attachment system which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations which fall within the broad scope of the appended claims.

What is claimed is:

1. An attachment system for use with a variable incidence vane system comprising:

a vane arm for connecting a unison ring and a spindle;

said vane arm having an arm portion and a bushing connected to said arm portion;

a pin for connecting said vane arm to said unison ring; and said pin fitting within said bushing and being joined to said unison ring by a dual swage.

2. The attachment system according to claim 1, wherein said bushing is connected to said arm portion by brazing.

3. The attachment system according to claim 1, wherein said bushing has no chamfered reliefs.

4. The attachment system according to claim 1, further comprising said vane arm having means for connecting said vane arm to said vane spindle.

5. The attachment system according to claim 4, wherein said connecting means comprises a claw having a tapered leading edge.

6. The attachment system according to claim 5, wherein said vane spindle has two offset slots and said connecting means further comprises first and second curved members for engaging said slots.

7. The attachment system according to claim 6, wherein said first curved member has a first radius of curvature, said second curved member has a second radius of curvature, and said first radius of curvature is different from said second radius of curvature.

8. A vane arm for use in an attachment system having a unison ring comprising:

an arm portion and a bushing connected to said arm portion;

said arm portion having a thickness;

said bushing having a height which is maximized to fit within a cross section of the unison ring with a clearance between top and bottom surfaces of said bushing sufficient to eliminate any potential for contact and subsequent wear of said top and bottom surfaces;

a tapered claw structure for joining said vane arm to another structure; and said tapered claw structure including a tapered leading edge.

9. A vane arm according to claim 8, wherein said tapered claw structure includes a first curved member having a first radius of curvature, a second curved member having a second radius of curvature, and said first radius of curvature being different from said second radius of curvature.

10. A vane arm for use in a gas turbine engine comprising an arm portion, a bushing at a first end of said arm portion, and an integrally formed tapered claw feature at a second end of said arm portion, and said claw feature comprising a first curved member having a tapered leading edge and a second curved member having a tapered leading edge.

11. A vane arm according to claim 10, wherein said first curved member has a first radius of curvature, said second curved member having a second radius of curvature, and said first radius of curvature is different from said second radius of curvature.

* * * * *